United States Patent [19]

Hucknall

[11] 3,989,291

[45] Nov. 2, 1976

[54] CONTROLLED ACCESS SLIDE BOLT

[76] Inventor: Richard Hucknall, 3 Fairview Ave., Great Neck, N.Y. 11023

[22] Filed: May 12, 1975

[21] Appl. No.: 576,692

[52] U.S. Cl. ..... 292/262

[51] Int. Cl.[2] ..... E05C 17/30

[58] Field of Search ..... 292/142, 262, 263, 264; 70/93

[56] References Cited

UNITED STATES PATENTS

| | | | |
|---|---|---|---|
| 1,215,286 | 2/1917 | Kollmeyer | 292/172 |
| 2,407,900 | 9/1946 | Paul | 70/93 |
| 3,869,886 | 3/1975 | Diaz | 292/262 X |

*Primary Examiner*—Richard E. Moore

*Attorney, Agent, or Firm*—Eisenman, Allsopp & Strack

[57] ABSTRACT

A dual function slide bolt unit operative either to secure doors or other members with a rigid slide bolt, or in a second operating mode to firmly hold the door or other member ajar by a predetermined amount. The unit comprises a bolt carriage connected to the door, a keeper connectable to a door jamb, and an articulated bolt member mounted within the carriage and selectively positionable within the keeper.

27 Claims, 10 Drawing Figures

32
42
50
33
16
49
22
24
47
6
39
38
46
48
31
8
9
37
70
63
62
61
11
65
64

CONTROLLED ACCESS SLIDE BOLT

BACKGROUND OF THE INVENTION

1. Field of the Invention

The invention relates to locking devices; and more particularly to slide bolt type locks which provide a rigid bar connection between the door and jamb.

2. Description of the Prior Art

Slide bolts are one of the earliest forms of locking means. They have taken the form of rigid members which can be either rotated or slid from a position on the member to be secured into a keeper on a rigid adjacent surface such as a door jamb. It has long been recognized that doors and windows may occasionally be advantageously held ajar or may be opened for a brief period of time while still retaining the security of a link between the door and jamb. The most common means of cheaply providing this limited opening function, is the well known chain which is mounted upon a door frame and connectable via a slide channel to the door itself. The art also includes other members in connection with window and door control whereby the member is mounted for example upon the frame and projects outwardly therefrom. In some instances a keeper upon the door or window is tracked by the projecting element and means are provided for securing these elements together at any predetermined position.

It is observed that the most important element in any security device, is the degree of reliability provided. This feature is importantly related to the mounting ease and operating ease of the unit when one considers the large number of non-professional installations involved. A general feature that has heretofore been lacking in devices of this type, relates to the ability to engage them from the opposite side of the door. Typically, one member of a family may be at home while the other is out. The security afforded by this type of device will prompt the occupant to use it. On the other hand, if the absent party is not able to gain access it requires disturbance of the occupant and often considerable inconvenience.

As the typical example of slide bolt and chains demonstrate, the prior art has also failed to provide a suitable dual purpose unit that can be employed for either rigid internal slide bolt protection or limited opening of the door or window.

SUMMARY OF THE INVENTION

The present invention is a slide bolt device which performs the normal locking functions of a slide bolt and in addition the functions of a conventional door chain. More particularly, the invention provides a device which totally controls the degree of opening of a door or window within a limited range from complete closure to several inches.

It is an object of the present invention to provide an improved slide bolt.

It is another object of the invention to provide an improved slide bolt security device which will permit the limited controlled opening of the element being secured.

Another object of the invention is to provide an improved slide bolt security device which can be operated from the remote side of the element being secured.

Another object of the invention is to provide an improved slide bolt security device which can be controlled from the outside of the element being secured, or which can be disabled from such outside access at will.

Yet another object of the present invention is the provision of an improved slide bolt security device which performs the dual function of a bar lock and limited opening fixture.

One of the features of the present invention relates to the use of a slide bolt carriage having a guide channel and a bolt retainer element pivotally mounted at the edge of a door. The bolt retainer guide is accordingly operable, when desired, to provide an alternative slide path for the bolt in the event it is desired to move the door itself to a position other than closed.

Another feature of the invention is an articulated slide bolt comprising a front and main section that are pivotally connected and adapted for orthogonal movement relative to one another. As a result of this articulated interconnection of the principal components of the slide bolt, it is possible to position the front end within a keeper member rigidly affixed to a door frame, for example, and rotate the major portion so that the door may be opened by sliding the abovementioned bolt retainer guide along the major portion of the bolt.

In accordance with a particular embodiment of the invention there is provided a security device comprising a slide bolt carriage with a bolt retainer guide pivotally mounted at one end thereof, a bolt assembly slidably engaged within the bolt retainer guide and having a front element pivotally connected thereto; and a keeper member adapted to accept and retain the front end of said bolt assembly.

The manner in which the above objects are achieved, details concerning the cited features, and other relevant features of the invention will be more clearly understood and appreciated from the following detailed description of a particular embodiment. This description is made in conjunction with the accompanying drawings.

DESCRIPTION OF THE PREFERRED EMBODIMENTS

Figure 1:
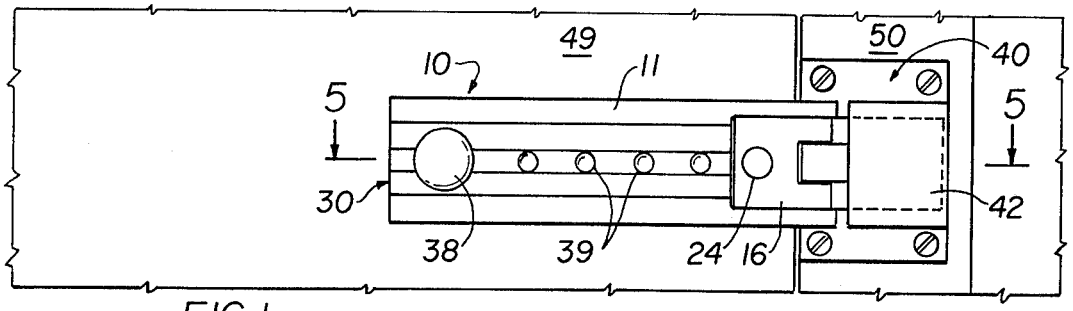
FIG. 1 is a front view of a preferred embodiment of the invention mounted in typical fashion upon a door and adjacent door jamb.

The simpler form of the invention may be appreciated by consideration of the embodiment shown in FIGS. 1 through 6. For ease of discussion and clarity of disclosure, reference numerals are used throughout the drawings. Common or similar parts in each Figure are identified by the same reference numeral.

The device consists of three basic sub-assemblies: the slide carriage 10; the slide bolt 30; and the keeper 40. The slide carriage is typically mounted upon a door 49 or similar unit whose opening is to be controlled. The keeper 40 is mounted in juxtaposition with the slide carriage on the jamb 50 or frame of the door. Thus, slide bolt 30 acts as the connecting link between the slide carriage and keeper.

Figure 4:
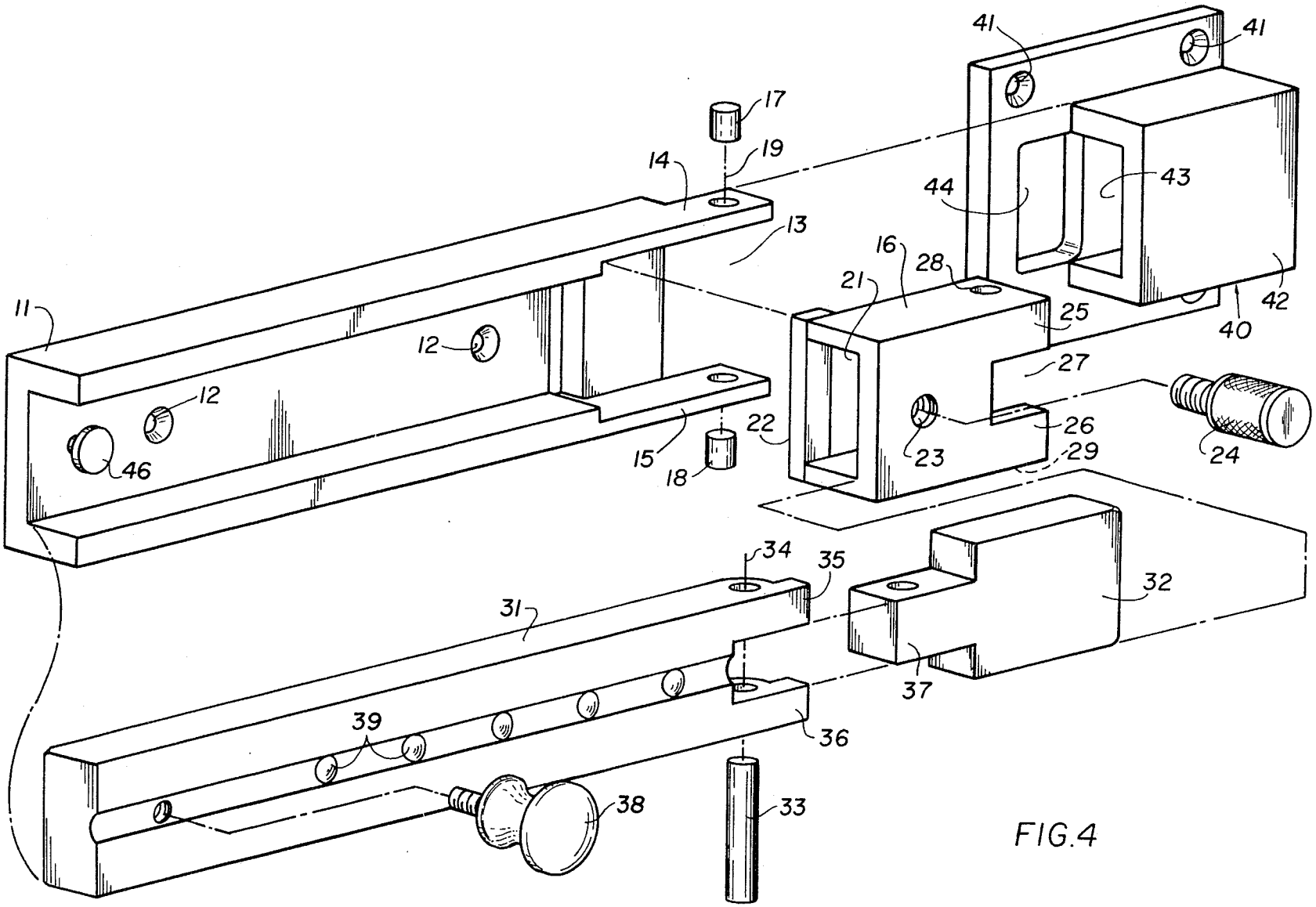
FIG. 4 is an exploded isometric view of the component parts of which the first embodiment is composed.

Before discussing the various operating modes of the device, an understanding of the structure of the various elements will be of assistance. FIG. 4 shows the slide bolt carriage to consist of a basic longitudinally channeled member 11 containing holes 12 for affixing the carriage to the door. One end of carriage 11 is provided with a slightly enlarged throat 13 and projecting legs 14, 15. These legs are adapted to mount the bolt retainer guide 16 by means of pins 17, 18. This mounting makes it possible for the bolt retainer guide to pivot about an axis 19 that is transverse the longitudinal axis of the slide carriage.

The bolt retainer guide is provided with a channel 21 therethrough. This channel is formed by the upper portion of the guide and, in the present case, by a lower element 22. The specific surrounding structure of channel 21 may vary. The function of this channel is to provide a guide and slide path for the slide bolt 30. In addition, a threaded hole 23 pierces the upper portion of the bolt retainer guide and a guide securing pin 24 is adapted for fastening therein. The tip of securing pin 24 extends beyond the inner aperture 21 when it is entered all the way and is used to prevent movement of the slide bolt 30, when this is desired.

The front portion of the bolt retainer guide extends forward as legs 25, 26 to form a yoke 27. This yoke is pierced by holes 28, 29 which are aligned with similar holes on the ends of the slide carriage in order to mount the pivot pins 17, 18.

Slide bolt 30 comprises a main bolt body 31 and the bolt tongue 32. These elements are articulated by means of a pivot pin 33 at one end of the bolt body in order to enable tongue 32 to pivot about axis 34. In the illustration, the bolt body 31 terminates in extending leg portions 35, 36 which form a channel for receipt of the projection 37 of tongue 32. A bolt handle 38 may be threadedly engaged at the remote end of the bolt, in order to facilitate its translation along the slide carriage. In addition, indentations 39 may advantageously be provided along the longitudinal axis of the bolt. These indentations are adapted to cooperate with the tip of the guide securing pin 24, in order to keep the bolt and retainer guide immobile relative to one another.

The keeper 40 functions to hold slide bolt 30 rigidly to the fixed door frame 50. Thus, it includes several holes 41 for the use of screws or the like, and a housing portion 42 with enclosed channel 43 for housing the tongue of the slide bolt. Obviously, when the slide carriage 10 and keeper 40 are mounted they must be arranged along a common longitudinal axis in order to slidingly receive slide bolt 30.

The edge of keeper 40 that is in proximity to the joint between the door and frame 49, 50, includes opening 44. This opening functions to hold the extending ends 35, 36 of the slide bolt when it is privoted in order to permit controlled opening of the door. In this situation, the tongue 32 would be retained within aperture 43 and the back shoulders of projections 35, 36, would be in contact with the left (as pictured) edges of opening 44.

Figures 5, 6, 7, 10:
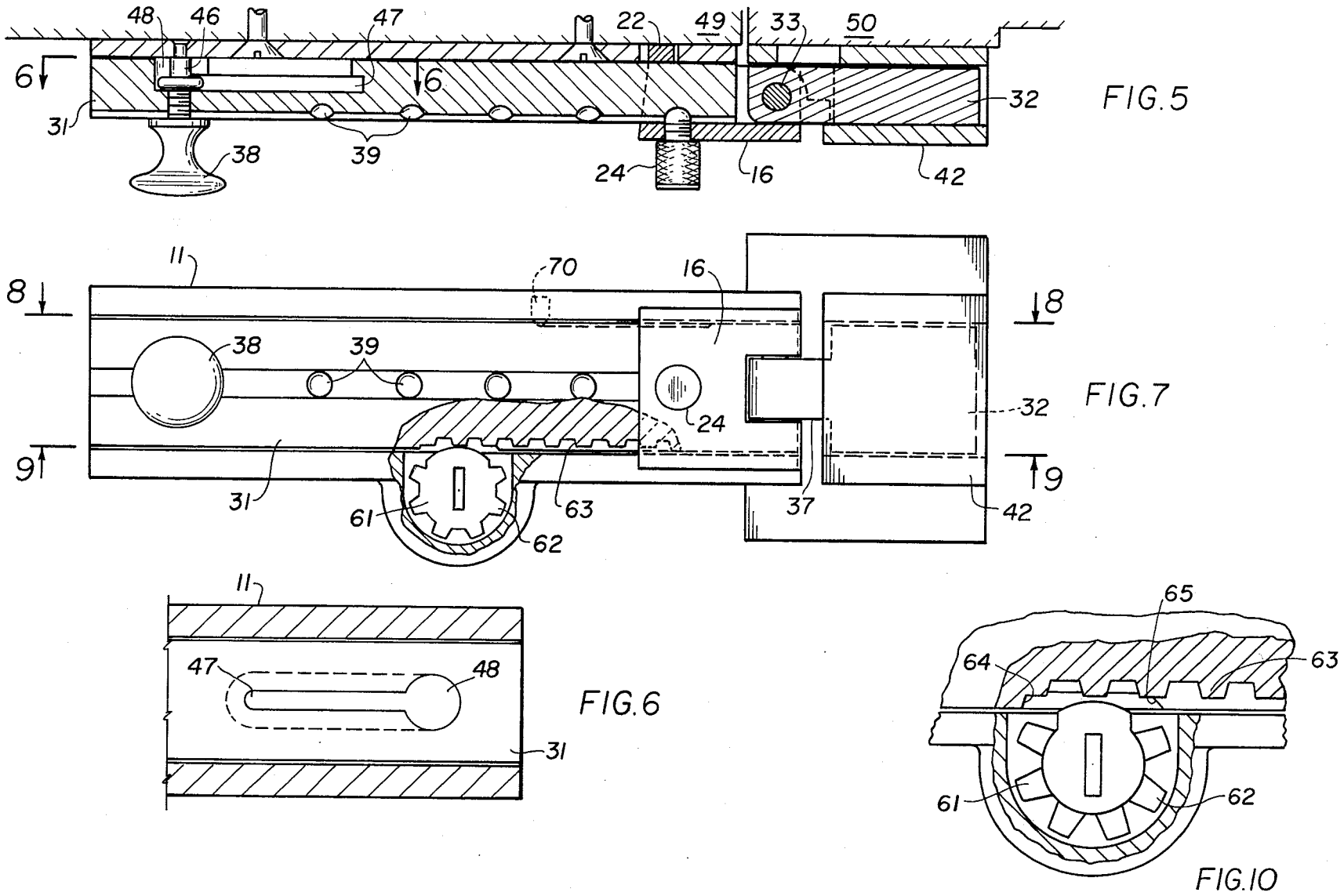
FIG. 5 is a cross-section taken along the line 5—5 of FIG. 1.
FIG. 6 is a fragmentary cross-section taken along the line 6—6 of FIG. 5 and illustrating the rear of the slide bolt with a slotted keeper track therein.
FIG. 7 is a front view of a second embodiment of the invention and includes a broken away portion, means for controlling the slide bolt from the remote side of the door.
FIG. 10 illustrates an alternative embodiment for controlling the bolt from the remote side of the door.

Before considering the various operating modes of the invention, one further structural feature of slide bolt assembly 30 and slide carriage 10, should be apprecited. FIG. 5 illustrates the assembled unit with slide bolt 30 moved forward into complete nesting in keeper 40. A flanged stud or retainer 46 is positioned substantially on the longitudinal axis of the slide carriage near the end remote from the edge of the door. The butting surface of slide bolt 30 includes a cooperating hole 48 and adjoining slotted track 47. FIG. 6 illustrates the basic configuration of this hole and slotted track. The cooperative dimensions of the flanged stud and slotted track permit entry of the head in the position shown. When the slide bolt 30 is moved to the left, the flange of stud 46 enters slots 47 while the head is trapped within the widened portion. Thus, the bolt is retained within the slide carriage.

Figure 2:
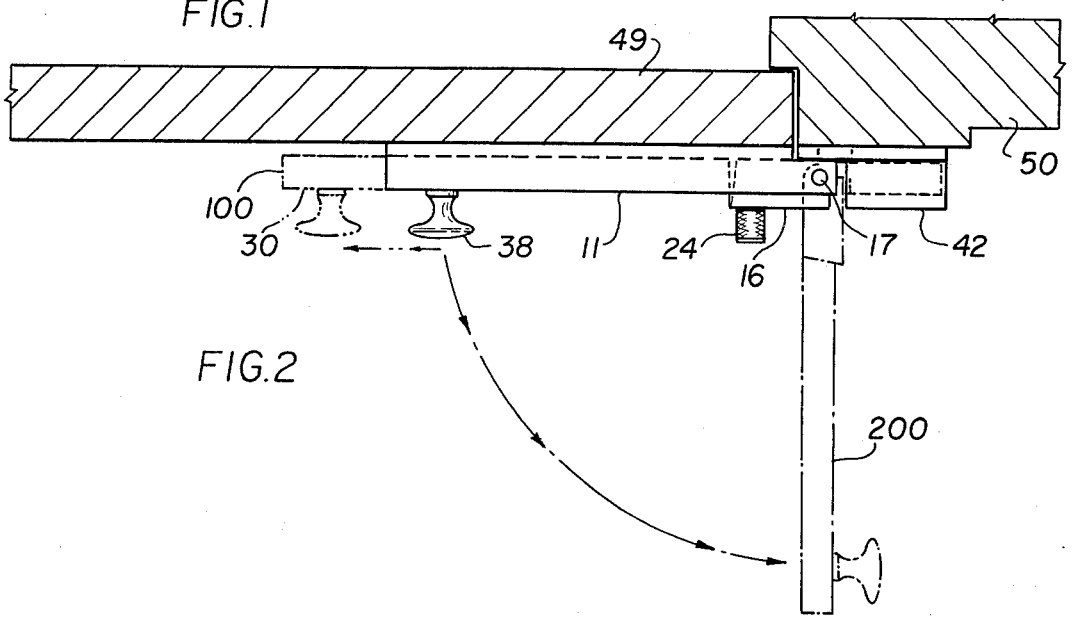
FIG. 2 is a plan view of the unit shown in FIG. 1, illustrating optional bolt positions in phantom outline.
Figure 3:
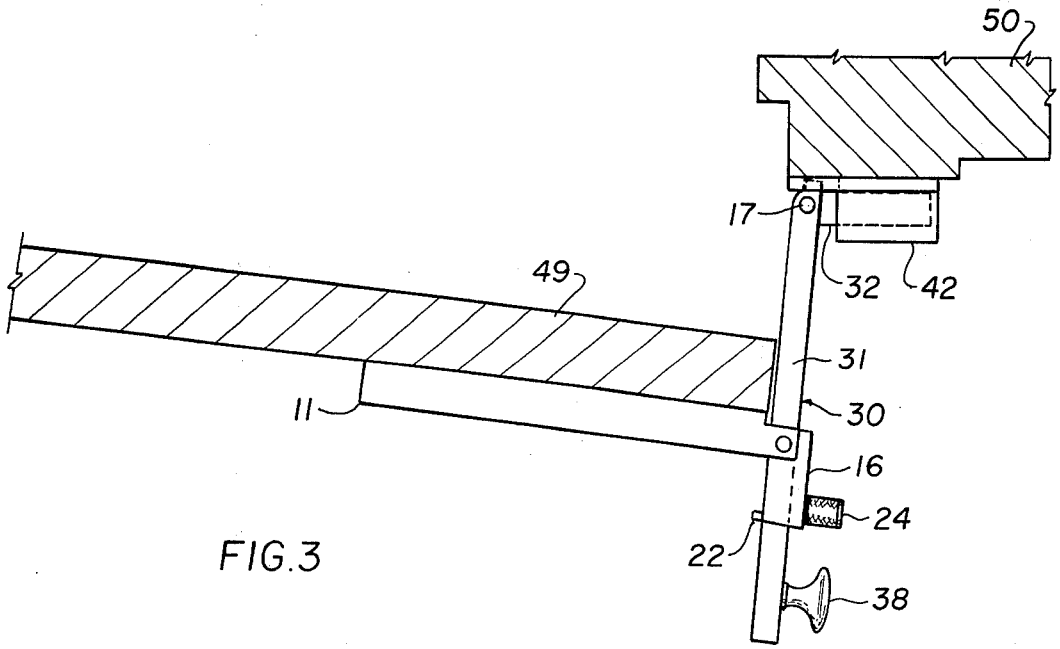
FIG. 3 is a plan view similar to that of FIG. 2, but showing the door retained in a partially open position.

FIGS. 2 and 3 are of assistance in appreciating the operation of the invention as a slide bolt and controlled opening device, respectively.

Phantom outline 100 in FIG. 2 shows the slide bolt 30 withdrawn toward the left, by the maximum amount possible. Under these circumstances, the tongue 32 of the slide bolt is within the bolt retainer guide 16, there is no physical connection between the slide bolt and keeper 40, and the door 49 may be opened at will. In order to engage the slide bolt, it is simply moved toward the right until tongue 32 is completely nested within the housing of keeper 40. Under this condition, any attempt to open door 49 meets with the rigid resistance of the slide bolt.

The second operating mode of this device concerns its controlled access feature. Phantom outline 200 in FIG. 2 illustrates rotation of slide bolt 30, 90° counter clockwise. This is effected by first sliding the bolt toward the right so that the tongue 32 is completely housed within keeper 40. In this position, the retainer 46 lies at access port 48 on the reverse side of the bolt (see FIG. 5) and it is thus possible to move bolt 30 outward and away from the slide channel of carriage 10. Outward movement takes place by pivoting of the bolt retainer guide 16 about axis 19. In the position shown in FIG. 2, the tongue 32 of bolt 30 is substantially at right angles with the body portion 31. In addition, axis 19 defined defined slide carriage 10 is substantially aligned with axis 34 defined by the slide bolt 30.

Once slide bolt 30 has been rotated in the manner shown, it is possible to open door 49 by sliding the bolt retainer guide 16 along bolt body 31. This is illustrated in FIG. 3. The maximum extent to which door 49 may be opened, is determined basically by the length of bolt 30.

The specific position in which the door is held, is determined by the setting of the bolt retainer guide pin 24 within the various apertures 39. It will be obvious that whereas a threaded pin 24 and detents 39 are illustrated in this embodiment, other means may be used with equal facility in accordance with the skilled designer's discretion.

Figure 8:
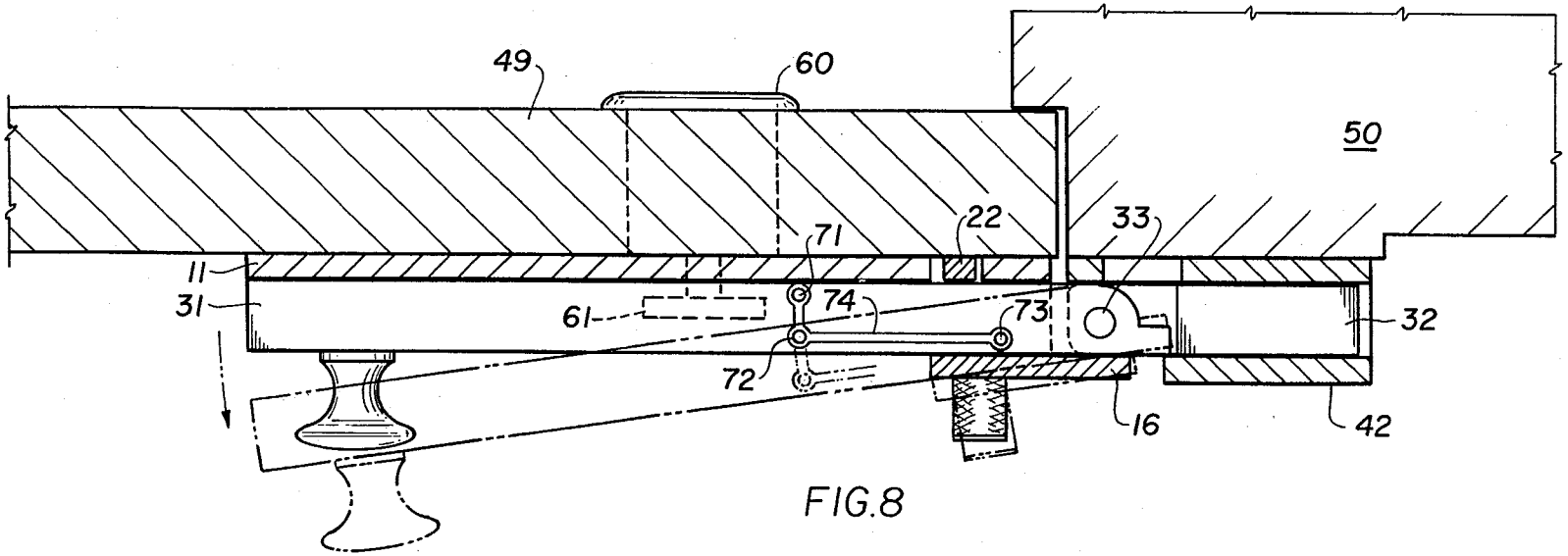
FIG. 8 is a cross-section taken along lines 8—8 of FIG. 7 and illustrates a detent track by means of which an occupant may disable the remote control feature of the security device.
Figure 9:
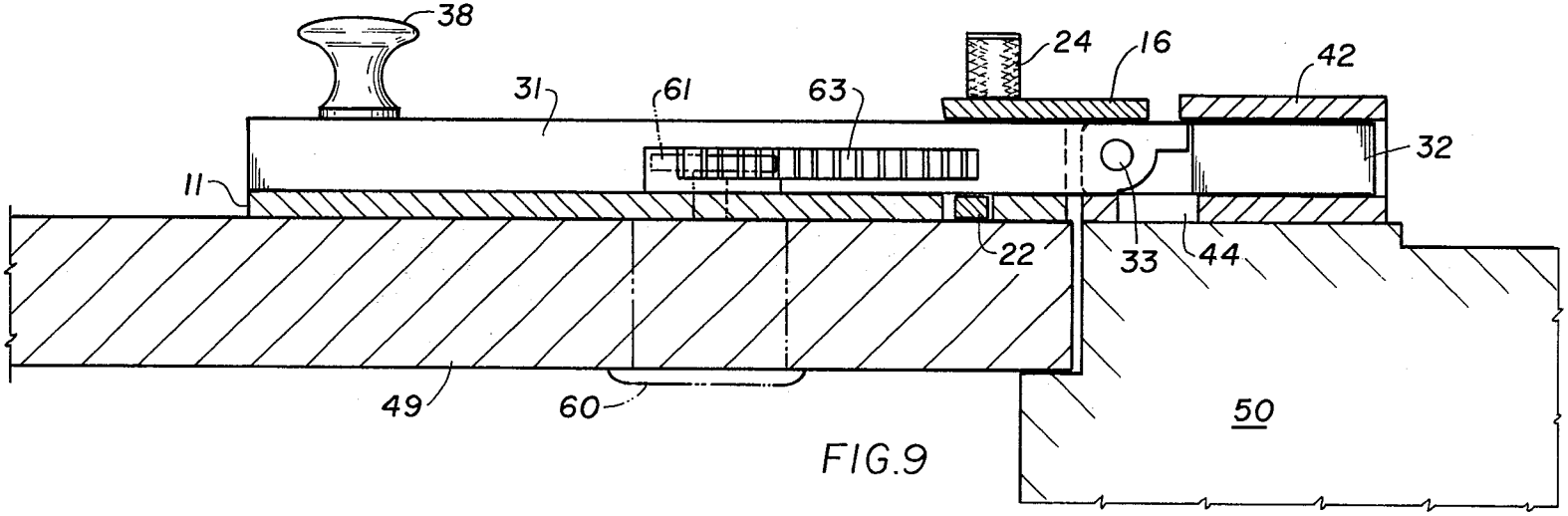
FIG. 9 is a section along the lines 9—9 of FIG. 7 and illustrates the lower portion of the bolt structure with a lock controlled rack thereon.

With an understanding of the basic operation of the invention, as either a slide bolt or controlled opening device, attention may be directed to FIGS. 7, 8 and 9 for a further embodiment wherein means are provided for use of the invention from a position on the remote side of the door. In this case, a typical cylinder lock 60 pierces door 49 and controls the rotation of a pinion 61. The pinion is provided with teeth 62 on a substantial portion of its circumference; however, one sector is provided without teeth and when the pinion is positioned as shown in FIG. 7, the unit operates in the same manner described above. A rack 63 is provided on the lower edge of slide bolt 30 when one wishes to employ external control means. Thus, by rotating pinion 61 the teeth 62 will engage rack 63 and effect the desired translation of the slide bolt 30 into either a nesting relationship with keeper 40, or disengagement. Thus, one is enabled to effect the slide bolt operation from the external side of door 49.

The embodiment of FIGS. 7, 8 and 9 contains yet another feature which permits selective disengagement of the external controlling lock. This is accomplished by means of detent 70 and mating track positions 71, 72, 73. It will be recalled that during slide bolt operation the first embodiment retained slide bolt 30 within the channel of carriage 10, by means of retainer 46 in guide 47. The second embodiment effects this retention of the slide bolt, by engagement of detent 70 in guide track 74. Extreme positions of this guide track are defined by somewhat greater indentations 72, 73. During normal operation of the slide bolt detent 70 simply holds it within track 74. On the other hand, when the user desires to disengage the external control means 60, slide bolt 30 is rotated slightly inward (counter clockwise) as shown in phantom outline in FIG. 8. This slight movement engages detent 70 in stop position 71. Under this condition, pinion 61 cannot engage rack 63 and accordingly the cylinder lock 60 has been disabled.

It may be desirable, when employing the external cylinder lock, to eliminate and replace the retainer element 46 and guide channel 47. FIG. 10 is an alternative form of the cutaway portion shown in FIG. 7. The basic difference resides in the fact that the rack 63 is recessed more deeply into the slide bolt and the pinion gear 61 projects into the rack channel at all times, including when the arcuate portion is in the position shown. The recessing is accomplished by increasing the depth of the shoulder 64. During slide bolt operation, the projection of the pinion into the rack channel acts to guide and hold the bolt in position against the door. To effect controlled access, a port or cutout, 65, is provided on the remote side of the slide bolt, so that it can be rotated free of the pinion 61, when the bolt is first moved all the way to the right.

Several specific illustrative embodiments of the invention have been shown and described. For illustrative purposes, reference has been made throughout to installation of the bolt assembly on a door. Obviously, other movable members, such as windows, can advantageously employ this type of mechanism. It should be appreciated that these particular embodiments may be modified by those skilled in the art without departing from the spirit and teachings herein. All such modifications are intended to be covered by the appended claims.

What is claimed is:

1. A slide bolt assembly for releasably securing a pair of relatively movable adjacent members, comprising: slide bolt retainer means mounted on one of said members and pivotable about an axis at the edge thereof, a keeper mounted at the adjacent edge of the other of said members, and a slide bolt mounted within said retainer and adapted for translation into said keeper when said members are substantially juxtaposed, the end of said slide bolt in proximity to said keeper, having a tongue pivotal about a transverse axis.

2. A slide bolt assembly as defined in claim 1, wherein said slide bolt retainer means includes a fixed longitudinally disposed slide channel to control the path of translation of said slide bolt.

3. A slide bolt assembly as defined in claim 2, wherein said slide channel includes means for securing said slide bolt therein and operative in substantially all positions except when said bolt is fully translated into said keeper.

4. A slide bolt assembly as defined in claim 3, wherein said slide bolt is rotatable out of said channel when the axes of said retainer means and said tongue are in substantial alignment.

5. A slide bolt assembly as defined in claim 4, wherein said retainer means includes means for selectively securing said slide bolt against translation therein.

6. A slide bolt assembly as defined in claim 4, wherein said keeper includes means operative to prevent said slide bolt from rotating beyond a predetermined angle relative to said other member.

7. A slide bolt assembly as defined in claim 1, comprising a means coupled to said slide bolt and operable from the remote side of said members to effect translation of said slide bolt.

8. A slide bolt assembly as defined in claim 7, wherein the means coupled to said slide bolt may be disengaged, from the side of said members upon which said assembly is mounted.

9. A slide bolt assembly for releasably securing a pair of relatively movable adjacent members, comprising: slide bolt retainer means mounted on one side of one of said members and pivotally mounted about an axis at the edge of said one member, a keeper mounted on the same side of the other of said members adjacent to said slide bolt retainer, a slide bolt mounted within said retainer and adapted for translation into said keeper when said members are substantially juxtaposed, the end of said slide bolt in proximity to said keeper having a tongue pivotal about a transverse axis, and control means operable from the remote side of said members to effect translation of said slide bolt.

10. A slide bolt assembly as defined in claim 9, wherein said slide bolt retainer means includes a fixed longitudinally disposed slide channel to control the path of translation of said slide bolt.

11. A slide bolt assembly as defined in claim 11, wherein said slide bolt is rotatable out of said channel when the axes of said retainer means and said tongue are in substantial alignment.

12. A slide bolt assembly as defined in claim 11, wherein said retainer means includes means for selectively securing said slide bolt against translation therein.

13. A slide bolt assembly as defined in claim 12, wherein said keeper includes means operative to prevent said slide bolt from rotating beyond a predetermined angle relative to said other member.

14. A slide bolt assembly as defined in claim 11, wherein said control means is inoperative when said slide bolt is rotated out of said channel by more than a predetermined angle.

15. A slide bolt assembly as defined in claim 14, including means for maintaining said slide bolt at said predetermined angle.

16. A slide bolt assembly as defined in claim 9, wherein said slide bolt includes a longitudinally disposed rack, and said control means includes a rotatable pinion coupled to said rack.

17. A slide bolt assembly as defined in claim 16, wherein said pinion is uncoupled to said rack when rotated to a predetermined position.

18. A slide bolt assembly as defined in claim 17, wherein said slide retainer means is pivotally mounted about an axis at the edge of said one member, and the end of said slide bolt in proximity to said keeper has a tongue pivotal about a transverse axis.

19. A slide bolt assembly as defined in claim 18, wherein said slide bolt retainer means includes a fixed longitudinally disposed slide channel to control the path of translation of said slide bolt.

20. A slide bolt assembly as defined in claim 19, wherein said slide channel includes means for securing said slide bolt therein and operative in substantially all positions except when said bolt is fully translated into said keeper.

21. A slide bolt assembly as defined in claim 20, wherein said slide bolt is rotatable out of said channel when the axes of said retainer means and said tongue are in substantial alignment.

22. A slide bolt assembly as defined in claim 21, wherein said retainer means includes means for selectively securing said slide bolt against translation therein.

23. A slide bolt assembly as defined in claim 22, wherein said keeper includes means operative to prevent said slide bolt from rotating beyond a predetermined angle relative to said other member.

24. A slide bolt assembly as defined in claim 3, wherein said means for securing the slide bolt in said slide channel is coupled to said slide bolt and operable from the remote side of said members to effect translation of said slide bolt.

25. A slide bolt assembly as defined in claim 24, wherein the means coupled to said slide bolt may be disengaged, from the side of said members upon which said assembly is mounted.

26. A slide bolt assembly as defined in claim 16, wherein said rack is recessed into the bottom of said slide bolt and said pinion projects into said recess.

27. A slide bolt assembly as defined in claim 26, wherein said pinion is uncoupled from said rack when rotated to a predetermined position and can be removed from said recess when the axes of said retainer means and said tongue are in substantial alignment.

* * * * *